US009631307B2

(12) United States Patent
Shomura

(10) Patent No.: US 9,631,307 B2
(45) Date of Patent: Apr. 25, 2017

(54) PRESSER FOOT FOR SEWING MACHINE

(71) Applicant: Janome Sewing Machine Co., Ltd., Tokyo (JP)

(72) Inventor: Eiichi Shomura, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 14/972,452

(22) Filed: Dec. 17, 2015

(65) Prior Publication Data

US 2016/0258095 A1 Sep. 8, 2016

(30) Foreign Application Priority Data

Mar. 6, 2015 (JP) ..... 2015-045260

(51) Int. Cl.
*D05B 29/08* (2006.01)
*D05B 35/06* (2006.01)

(52) U.S. Cl.
CPC ..... *D05B 29/08* (2013.01); *D05B 35/06* (2013.01)

(58) Field of Classification Search
CPC ..... D05B 29/06; D05B 29/08; D05B 29/10
See application file for complete search history.

(56) References Cited

U.S. PATENT DOCUMENTS 3,618,547 A * 11/1971 Howell ..... D05B 3/18 112/240
4,159,001 A * 6/1979 Doori ..... D05B 29/06 112/150
4,892,047 A 1/1990 Fieschi
5,410,975 A * 5/1995 Dudek ..... D05B 35/064 112/113
6,123,039 A * 9/2000 Niino ..... D05B 29/08 112/235
6,792,883 B2 * 9/2004 Ashton ..... D05B 31/00 112/235
7,080,605 B1 * 7/2006 Anderson ..... D05B 27/12 112/318
9,062,401 B2 * 6/2015 Matsushima ..... A41H 37/003
9,212,438 B2 * 12/2015 Kato ..... D05B 19/16
9,279,204 B2 * 3/2016 Tomizawa ..... D05B 29/06

FOREIGN PATENT DOCUMENTS

CN 103710894 A 4/2014
CN 204039698 U 12/2014
JP H07-272 U 1/1995
JP H08-309061 A 11/1996

* cited by examiner

*Primary Examiner* — Danny Worrel
(74) *Attorney, Agent, or Firm* — Nakanishi IP Associates, LLC

(57) ABSTRACT

A presser foot for a sewing machine includes: a presser main body having an opening in which an upper feed dog is to be arranged, and configured to press a cloth; a rotational shaft connected to an upper feed mechanism of the sewing machine; a guide base provided to the presser main body so as to form a single unit, and configured to guide a ribbon; right and left guides configured as a pair of members provided such that they can be relatively moved with respect to the guide base, and to guide a position of the ribbon in the width direction, and arranged symmetrically with a position at which a sewing needle moves in a vertical direction as a base position; and an adjustment screw, right and left guide bushes, configured as a linking portion that links the movements of the right and left guides.

6 Claims, 8 Drawing Sheets

PRESSER FOOT FOR SEWING MACHINE

This application is based on and claims the benefit of priority to Japanese Patent Application No. 2015-045260 filed on Mar. 6, 2015, the contents of which are hereby incorporated by reference in their entirety.

BACKGROUND OF THE INVENTION

1. Field of the Invention

The present invention relates to a presser foot for a sewing machine.

2. Description of the Related Art

In a case in which a long, thin band-shaped (tape-shaped) member such as lace, a ribbon, a rubber band, or the like is sewn as a decoration member or a reinforcement member to a sewing target object such as a cloth or the like, there is a need to hold the band-shaped member and such a sewing target object so as to prevent them from jolting out of alignment.

Patent document 1 discloses a presser foot with a tape guide member included in a sewing machine that provides tape sewing. With such a presser foot with a tape guide member disclosed in Patent document 1, by guiding a tape to a predetermined position, such an arrangement is capable of sewing the tape to a sewing target object with high positioning precision.

RELATED ART DOCUMENTS

Patent Documents

[Patent Document 1]

Japanese Patent Application Laid-Open No. H08-309061

SUMMARY OF THE INVENTION

However, with such an apparatus disclosed in Patent document 1, every time the width of a tape (band-shaped member) used for sewing is changed, there is a need to loosen a clamp screw and to tighten the screw again after the tape guide member is adjusted according to the tape width. In addition, in a case in which the width of the tape changes, the center of the tape also changes with respect to the needle position. Accordingly, such an arrangement requires a positioning operation in which centering of the tape is performed again. Such a positioning operation requires the user to loosen the clamp screw. As described above, such an apparatus disclosed in Patent document 1 requires the user to perform an adjustment operation multiple times. This requires the user to loosen and tighten the screw for every adjustment operation, which is troublesome.

In a case in which a band-shaped member and a sewing target object are layered and sewn together, in some cases, there is a substantial difference in the feeding rate between them, leading to a problem of sewing misalignment. Such a problem occurs in a case in which the sewing target object and the band-shaped member are not fed at the same rate with high precision due to differences in the material properties and size between them in a state in which they are held between a presser foot arranged on the upper side and a feed dog arranged on the lower side.

One or more embodiments of the present invention provide a presser foot for a sewing machine that is capable of adjusting the guiding width in a simple manner according to the width of a band-shaped member to be used without a need to perform centering adjustment of the band-shaped member with respect to the needle position, and that has an advantage of suppressing sewing misalignment between the band-shaped member and a sewing target object.

Means for Solving the Problems

Embodiment 1

One or more embodiments of the present invention relate to a presser foot for a sewing machine. The presser foot comprises: a presser main body that has an opening in which an upper feed dog is to be arranged, and that presses a sewing target object; a connection portion that is connected to an upper feed mechanism of the sewing machine; a guide base provided to the presser main body so as to form a single unit, and configured to guide a band-shaped member to be sewn to the sewing target object; guide members configured as a pair of members that are provided such that they can be relatively moved with respect to the guide base, that guide a position of the band-shaped member in a width direction, and that are arranged symmetrically with a position at which a sewing needle moves in a vertical direction as a base position; and a linking portion that links movements of the guide members such that they are positioned symmetrically at all times with respect to the base position.

Embodiment 2

One or more embodiments of the present invention relate to the presser foot for a sewing machine according to the aforementioned embodiment 1. With such an embodiment, the linking portion comprises: a male screw member configured such that a right male screw is formed in one end thereof, and such that a left male screw is formed in the other end thereof; a right female screw provided to one of the guide members, and configured to be joined to the right male screw; and a left female screw provided to the other one of the guide members, and configured to be joined to the left male screw.

Embodiment 3

One or more embodiments of the present invention relate to the presser foot for a sewing machine according to the aforementioned embodiment 2. With such an embodiment, the right female screw and the left female screw are each configured as a component separate from the guide members, i.e., as a separate female screw member. Furthermore, each female screw member is applied to the corresponding guide member so as to form a single unit, thereby providing the right female screw and the left female screw to the corresponding guide members.

Embodiment 4

One or more embodiments of the present invention relate to the presser foot for a sewing machine according to the aforementioned embodiment 1. With such an embodiment, the presser main body is connected to a presser unit mounted to a presser rod included in the sewing machine having an upper feed mechanism. Furthermore, the presser unit is configured to be detachably mounted to the presser rod.

Embodiment 5

One or more embodiments of the present invention relate to the presser foot for a sewing machine according to the aforementioned embodiment 2. With such an embodiment, the presser main body is connected to a presser unit mounted to a presser rod included in the sewing machine having an upper feed mechanism. Furthermore, the presser unit is configured to be detachably mounted to the presser rod.

Embodiment 6

One or more embodiments of the present invention relate to the presser foot for a sewing machine according to the aforementioned embodiment 3. With such an embodiment, the presser main body is connected to a presser unit mounted to a presser rod included in the sewing machine having an upper feed mechanism. Furthermore, the presser unit is configured to be detachably mounted to the presser rod.

With one or more embodiments according to the present invention, such an arrangement allows the presser foot for a sewing machine to adjust the guiding width in a simple manner according to the width of a band-shaped member to be used. In addition, such an arrangement requires no centering adjustment of the band-shaped member with respect to the needle position. Furthermore, such an arrangement provides an upper feed operation, thereby suppressing sewing misalignment between a sewing target object and a band-shaped member.

DESCRIPTION OF THE PREFERRED EMBODIMENTS

Description will be made with reference to the drawings and the like regarding a best mode for carrying out the present invention.

Embodiment

Figure 1:
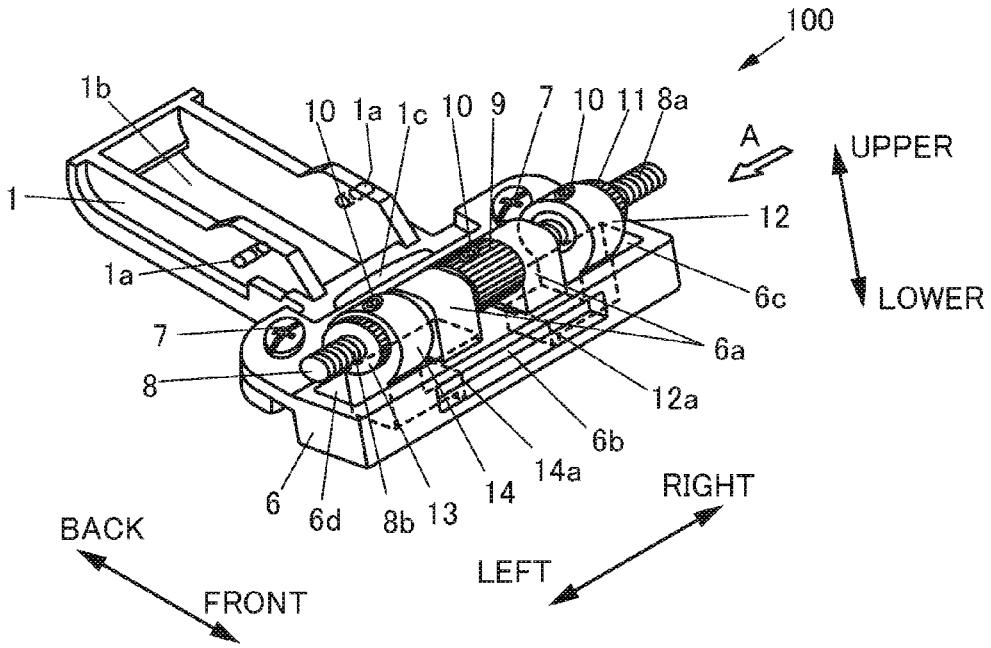
FIG. 1 is a perspective view showing an embodiment of a presser foot 100 of a sewing machine according to the present invention.
Figure 2:
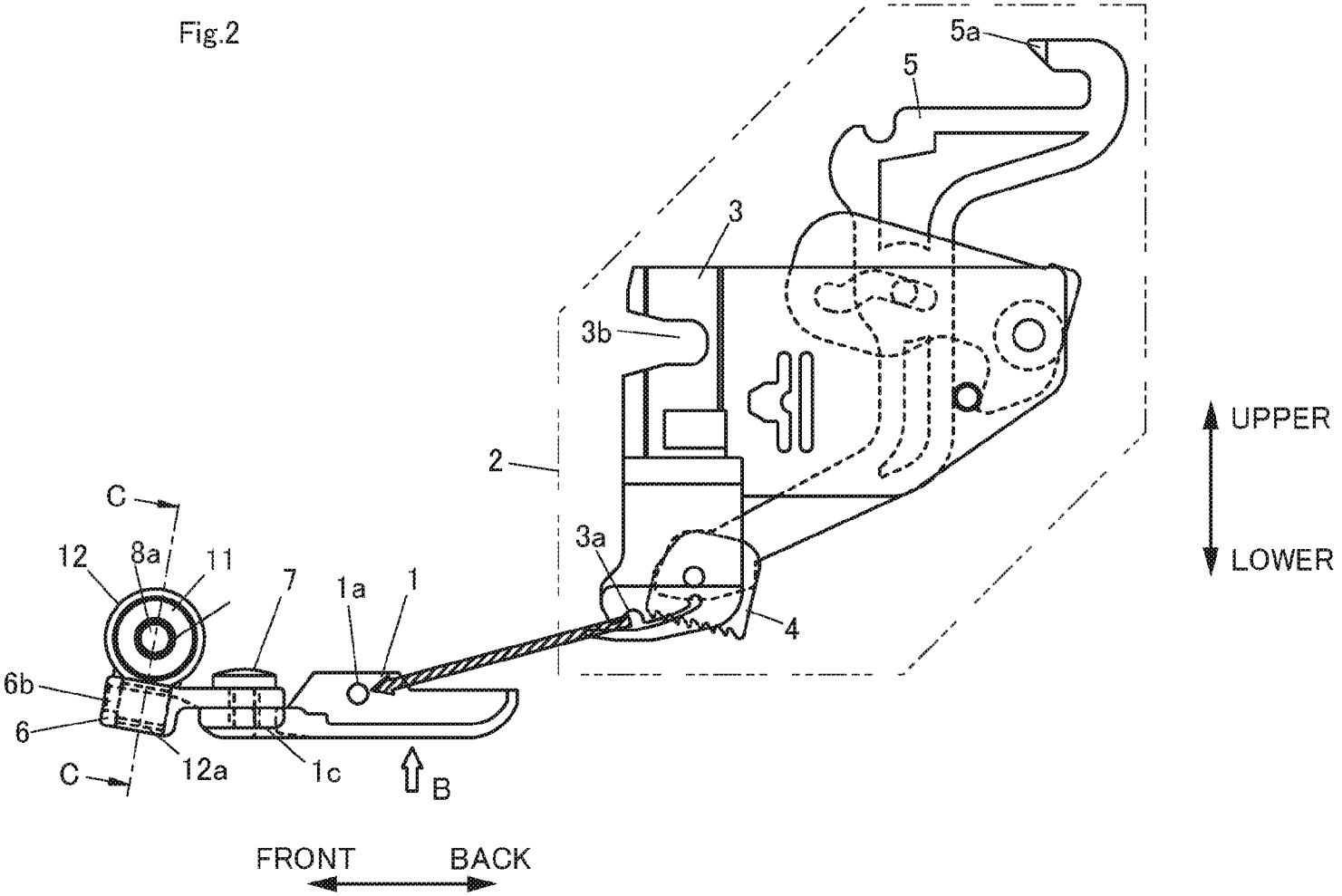
FIG. 2 is a diagram showing the presser foot 100 and a presser unit 2 as viewed from the direction indicated by the arrow A shown in FIG. 1.
Figure 3:
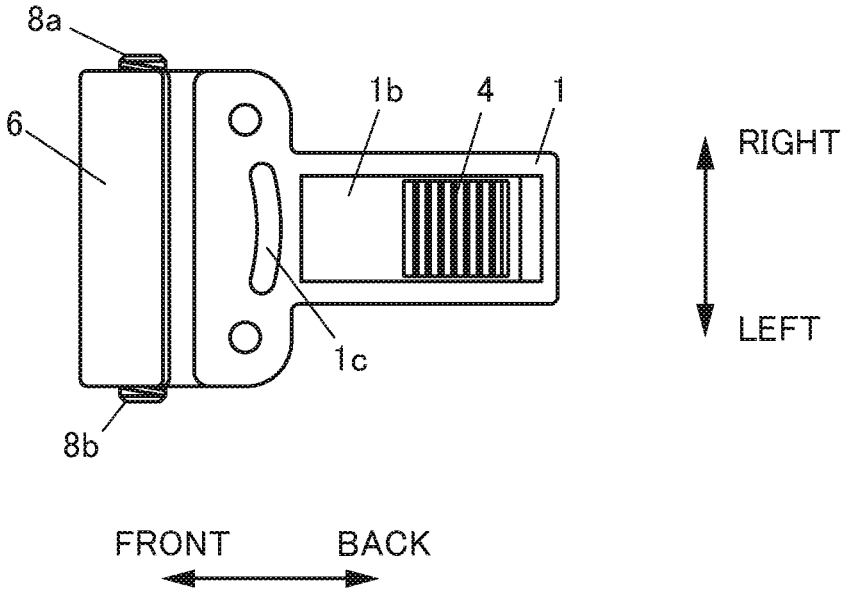
FIG. 3 is a diagram showing the presser foot 100 for a sewing machine as viewed from the direction indicated by the arrow B shown in FIG. 2.
Figure 4:
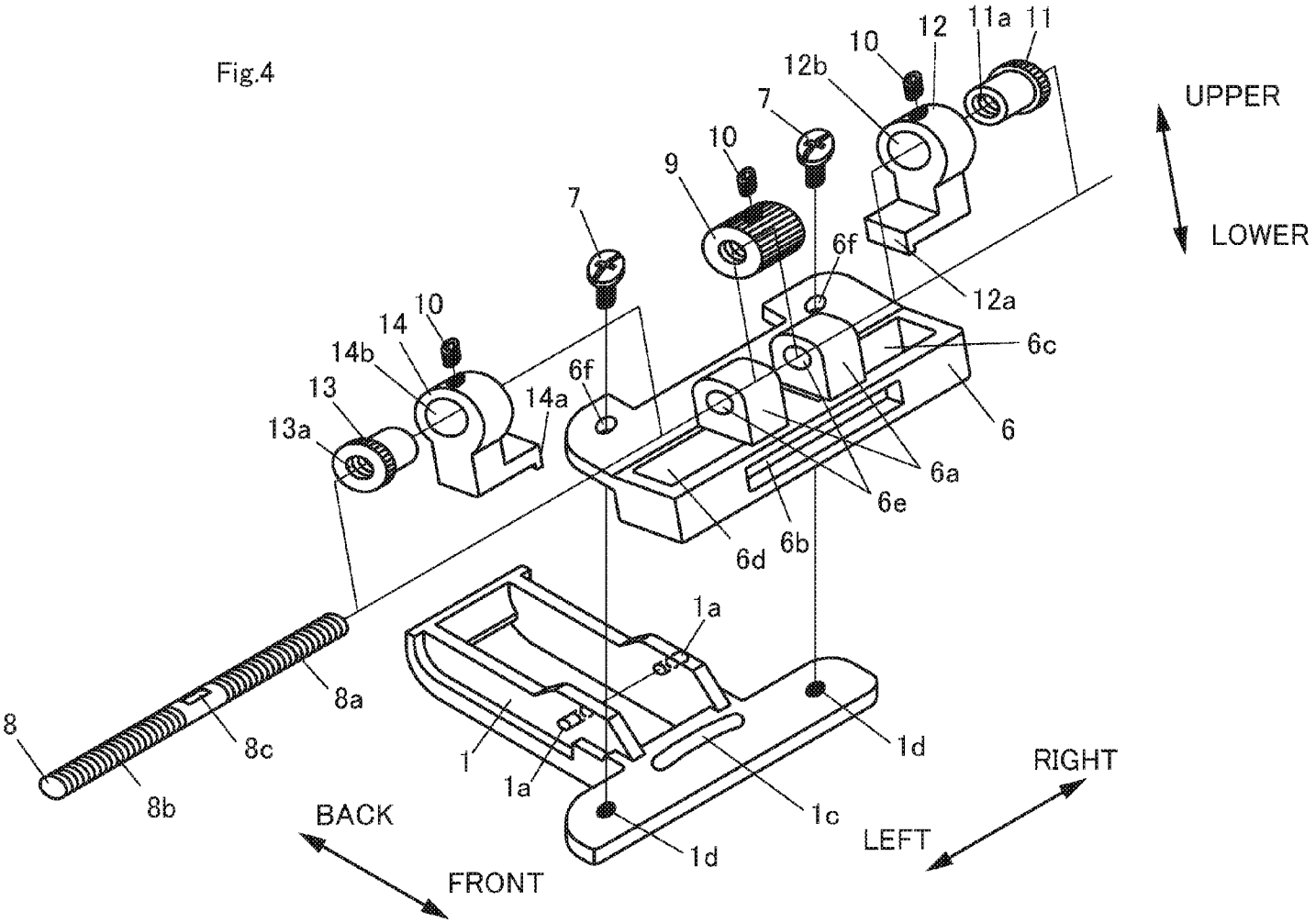
FIG. 4 is an exploded perspective view showing a component configuration of the presser foot 100 for the sewing machine.

FIG. 1 is a perspective view showing an embodiment of a presser foot 100 for a sewing machine according to the present invention. FIG. 2 is a diagram showing the presser foot 100 and a presser unit 2 as viewed from the direction indicated by the arrow A shown in FIG. 1. FIG. 3 is a diagram showing the presser foot 100 for a sewing machine as viewed from the direction indicated by the arrow B shown in FIG. 2. It should be noted that FIG. 3 also shows an upper feed dog 4 together with the presser foot 100. FIG. 4 is an exploded perspective view showing a component configuration of the presser foot 100 for the sewing machine.

It should be noted that the following drawings including FIGS. 1 through 4 each show a schematic configuration. For ease of understanding, each component is shown with a different size or different shape as appropriate.

Also, description will be made below regarding an arrangement with specific values, shapes, materials, etc. However, such factors may be changed as appropriate.

Also, for ease of understanding and for convenience of description, description will be made as appropriate using six directions, i.e., the front side, back side, left side, right side, upper side, and lower side, as indicated by the arrows in the drawings. However, such directions by no means restrict the configuration of the invention.

The presser foot 100 includes a presser main body 1, a guide base 6, an adjustment screw 8, an operation ring 9, a right guide bush 11, a right guide 12, a left guide bush 13, and a left guide 14.

The presser main body 1 has a function for pressing a sewing target object such as a cloth or the like in the sewing operation. In particular, in addition to pressing such a cloth or the like, the presser main body 1 according to the present embodiment presses, from the upper side, a ribbon to be sewn to a cloth or the like in a state in which it is guided in the left-right direction by means of the right guide and the left guide 14 as described later. With such an arrangement, the presser main body 1 holds a ribbon (band-shaped member) and a sewing target object such as a cloth or the like with a suitable pressure with respect to a sewing needle 17 configured to be moved in the vertical direction, thereby providing appropriate sewing. In the sewing operation, the presser main body 1 appropriately holds the sewing target object which is fed by means of a feed dog arranged on the lower side of the sewing target object and configured to be moved in the vertical direction and in the front-back direction.

It should be noted that description will be made with a ribbon as a typical example of such a band-shaped member to be guided by the right guide 12 and the left guide 14. That is to say, description will be made regarding each component using the term "ribbon" for exemplary purposes. However, such a band-shaped member to be held by the presser foot 100 according to the present embodiment is not restricted to such a ribbon. Also, the presser foot 100 according to the present embodiment is applicable to other kinds of band-shaped members such as tape, lace, rubber bands, or the like, in the same way as the ribbon.

The presser main body 1 has a needle opening 1*c*. In the sewing operation, the sewing needle 17 passes through the needle opening 1*c*. In order to fixedly mount the guide base 6, screw holes 1*d* are provided to the front side of the presser main body 1 such that they are each configured as a screw hole extending in the vertical direction.

Furthermore, a pair of rotational shafts 1*a* are respectively provided to the side plates configured as a rear portion of the presser main body 1 such that they respectively protrude toward the left side and the right side. This provides a connection portion at which the presser unit 2 can be connected to the rotational shafts 1*a*. By fitting the rotational shafts 1*a* to a holder groove 3*a* formed in a presser holder 3 configured as a component of the presser unit 2, the presser main body 1 is detachably mounted to the presser unit 2.

Furthermore, the presser main body 1 has an operating space (opening) 1*b* for the upper feed dog 4 in its central rear portion. In the operating space 1*b*, the upper feed dog 4 is moved in the front-back direction and in the vertical direction in order to feed a ribbon and a cloth.

The guide base 6 is fixed to the presser main body 1 by tightening screws 7 in screw holes 1*d* via openings 6*f* such that the guide base 6 is positioned closer to the front side than the needle opening 1*c* of the presser main body 1 and such that they are configured as a single unit. A pair of boss portions 6*a* are provided to the guide base 6 such that they are positioned roughly in the center thereof and such that they protrude toward the upper side. A through hole 6*e* is formed in each boss portion 6*a*, and is configured to rotatably hold an adjustment screw 8. A ribbon insertion window 6*b* configured as an opening is provided to the front end of the guide base 6. Furthermore, a groove 6*c* configured to hold the right guide 12 and a groove 6*d* configured to hold the left guide 14 are formed on the upper face of the guide base 6. The window 6*b* and the groove 6*c* are configured such that they communicate with each other in the interior of the guide base 6. Also, the window 6*b* and the groove 6*d* are configured such that they communicate with each other in the interior of the guide base 6.

The guide base 6 is provided with a guide member and a linking portion that form a guide mechanism configured to guide a ribbon. The guide members are arranged such that they can be relatively moved with respect to the guide base 6, and are configured as a pair of members that guide the position of a ribbon (band-shaped member) in the width direction. The guide members are arranged so as to be symmetrical with a position at which the sewing needle moves in the vertical direction as a base position. In the present embodiment, as such guide members, the right guide 12 and the left guide 14 are provided.

Moreover, the linking portion provides a function to link the movements of the guide members such that the guide members are arranged symmetrically at all times with respect to the base position. In the present embodiment, the linking portion is configured as a so-called feed screw mechanism including the adjustment screw 8, the right guide bush 11, and the left guide bush 13.

The adjustment screw (male screw member) 8 is mounted to the boss portions 6*a* such that it extends in the left-right direction, and such that it can be rotated with respect to the guide base 6. The adjustment screw 8 is configured such that a right male screw 8*a* is formed on its right side and a left male screw 8*b* is formed on its left side. The right male screw 8*a* and the left male screw 8*b* have the same parameters such as the nominal size, pitch, number of threads, and the like, except that the right male screw 8*a* is configured as a right screw and the left male screw 8*b* is configured as a left screw. A cut face 8*c* is formed in the central portion of the adjustment screw 8, which provides a face for receiving a screw 10 configured to fix the operation ring 9.

The operation ring 9 is fixed to a central portion of the adjustment screw 8 by means of the screw 10 such that it is interposed between the boss portions 6*a* of the guide base 6. This allows the operation ring 9 to be rotated together with the adjustment screw 8 as a single unit.

The right guide bush (female screw member) 11 has a right female screw 11*a* configured such that the right male screw 8*a* can be fitted to it by screw engagement. The right guide bush 11 is inserted into a through hole 12*b* formed in the right guide 12. In this state, the right guide bush 11 is fixed to the right guide 12 by means of the screw 10 so as to form a single unit.

The right guide 12 has a guide portion 12*a* on its lower side, and has the through hole 12*b* on its upper side. The lower portion of the right guide 12 is arranged within the groove 6*c* of the guide base 6. The guide portion 12*a* is arranged such that it protrudes from the groove 6*c* toward the window 6*b* side (see FIG. 5 described later). Furthermore, with the right guide bush 11 fixed to the right guide 12, the right male screw 8*a* is fitted by screw engagement to the right female screw 11*a* of the right guide bush 11. Thus, by rotating the adjustment screw 8, such an arrangement is capable of moving the right guide 12 in the left-right direction according to the rotational direction of the adjustment screw 8.

The left guide bush (female screw member) 13 has a left female screw 13*a* configured such that the left male screw 8*b* can be fitted to it by screw engagement. The left guide bush 13 is inserted into a through hole 14*b* formed in the left guide 14. In this state, the left guide bush 13 is fixed to the left guide 14 by means of the screw 10 so as to form a single unit.

The left guide 14 has a guide portion 14*a* on its lower side, and has the through hole 14*b* on its upper side. The lower portion of the left guide 14 is arranged within the groove 6*d* of the guide base 6. The guide portion 14*a* is arranged such that it protrudes from the groove 6*d* toward the window 6*b* side (see FIG. 5 described later). Furthermore, with the left guide bush 13 fixed to the left guide 14, the left male screw 8*b* is fitted by screw engagement to the left female screw 13*a* of the left guide bush 13. Thus, by rotating the adjustment screw 8, such an arrangement is capable of moving the left guide 14 in the left-right direction according to the rotational direction of the adjustment screw 8.

Here, the right guide 12 and the left guide 14 are arranged so as to be symmetrical, with a position at which the sewing needle 17 moves in the vertical direction as a base position.

As described above, the adjustment screw 8 is provided with the right male screw 8*a* and the left male screw 8*b*. The right male screw 8*a* is fitted by screw engagement to the right guide bush 11 such that the right guide bush 11 and the right guide 12 are arranged in the form of a single unit. Furthermore, the left male screw 8*b* is fitted by screw engagement to the left guide bush 13 such that the left guide bush 13 and the left guide 14 are arranged in the form of a single unit. Thus, by rotating the adjustment screw 8, such an arrangement is capable of symmetrically moving the right guide 12 and the left guide 14 in a direction such that the distance between them is increased or otherwise reduced.

Figure 5:
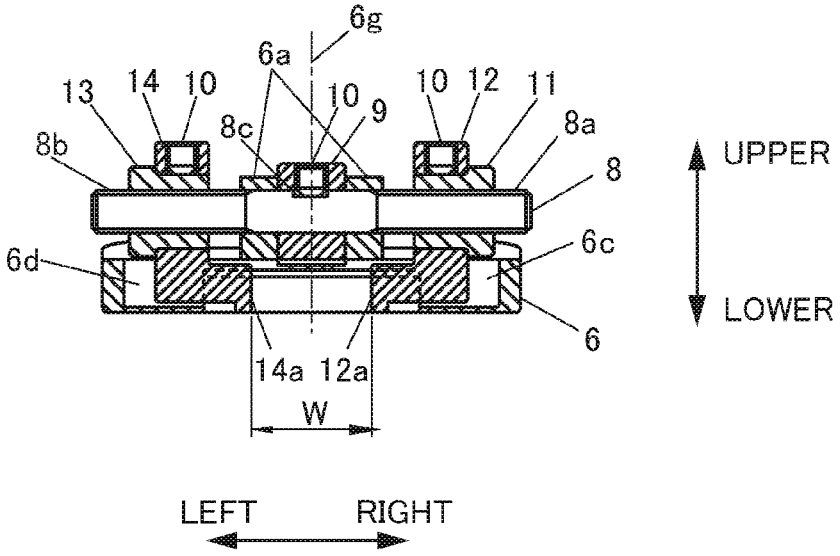
FIG. 5 is a cross-sectional view taken along a line indicated by the arrows C shown in FIG. 2.

FIG. 5 is a cross-sectional view taken along a line indicated by the arrows C shown in FIG. 2.

With the presser foot 100 having the aforementioned configuration, a ribbon inserted into the ribbon insertion window 6*b* is guided by the guide portions 12*a* and 14*a* to a position (roughly at a center portion of the presser main body 1) at which the sewing needle 17 moves in the vertical direction.

Specifically, the right male screw 8*a* and the left male screw 8*b* are respectively formed in both ends of the adjustment screw 8. Thus, by manual rotation of the operation ring 9, such an arrangement is capable of rotating the adjustment screw 8, thereby allowing the right guide 12 and the left guide 14 to be moved symmetrically with respect to the center (needle center) 6*g* of the guide base 6. That is to say, such an arrangement allows the right guide 12 and the left guide 14 to be moved simultaneously outward or otherwise inward, thereby increasing or otherwise reducing the distance between them. The guide portion 12*a* of the right guide 12 and the guide portion 14*a* of the left guide 14 function as guide faces for guiding both sides of the ribbon. That is to say, such an arrangement allows the width W to be controlled.

Figure 6:
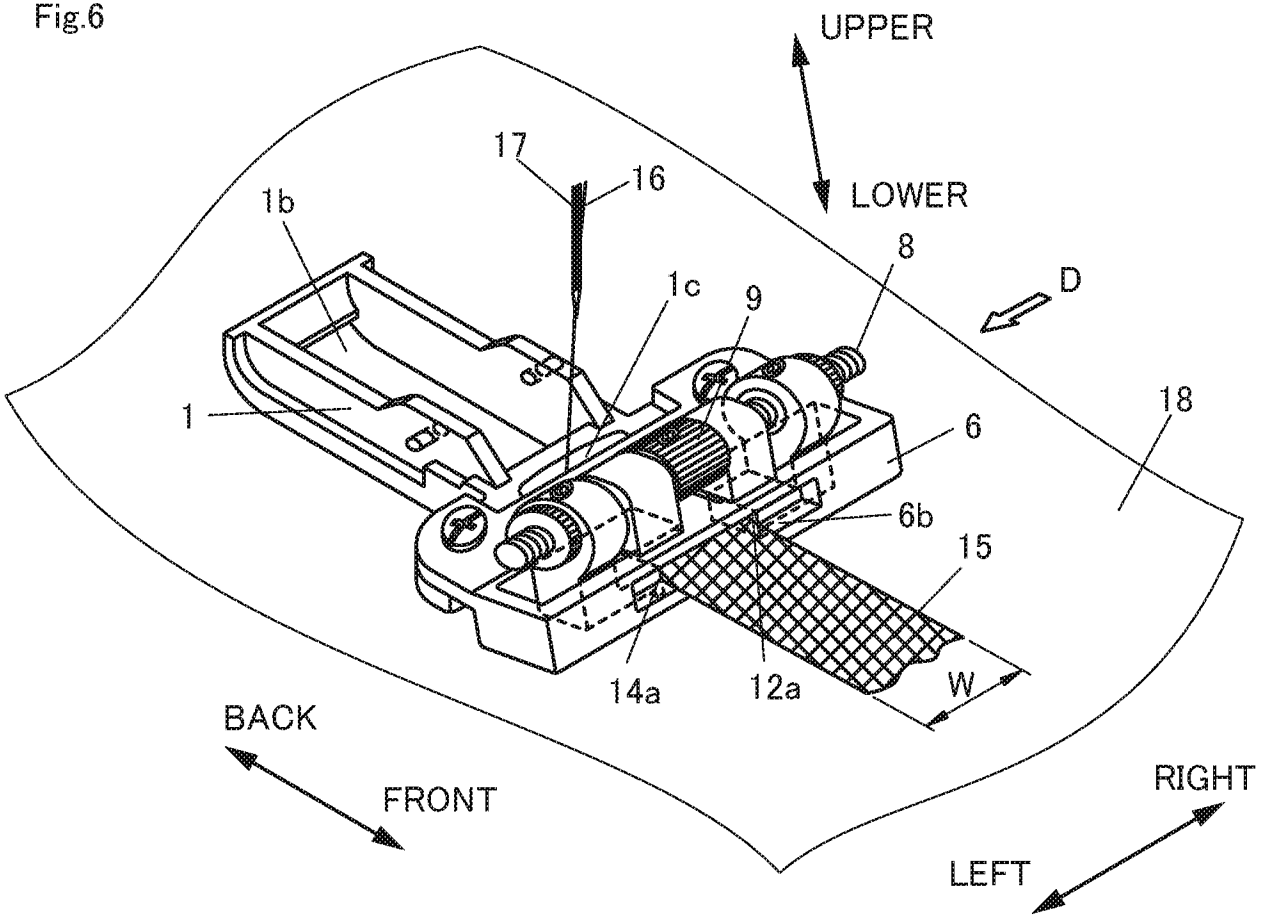
FIG. 6 is a perspective view showing the presser foot 100 in a state in which a ribbon is being sewn.

FIG. 6 is a perspective view showing the presser foot 100 in a state in which a ribbon is being sewn.

Figure 7:
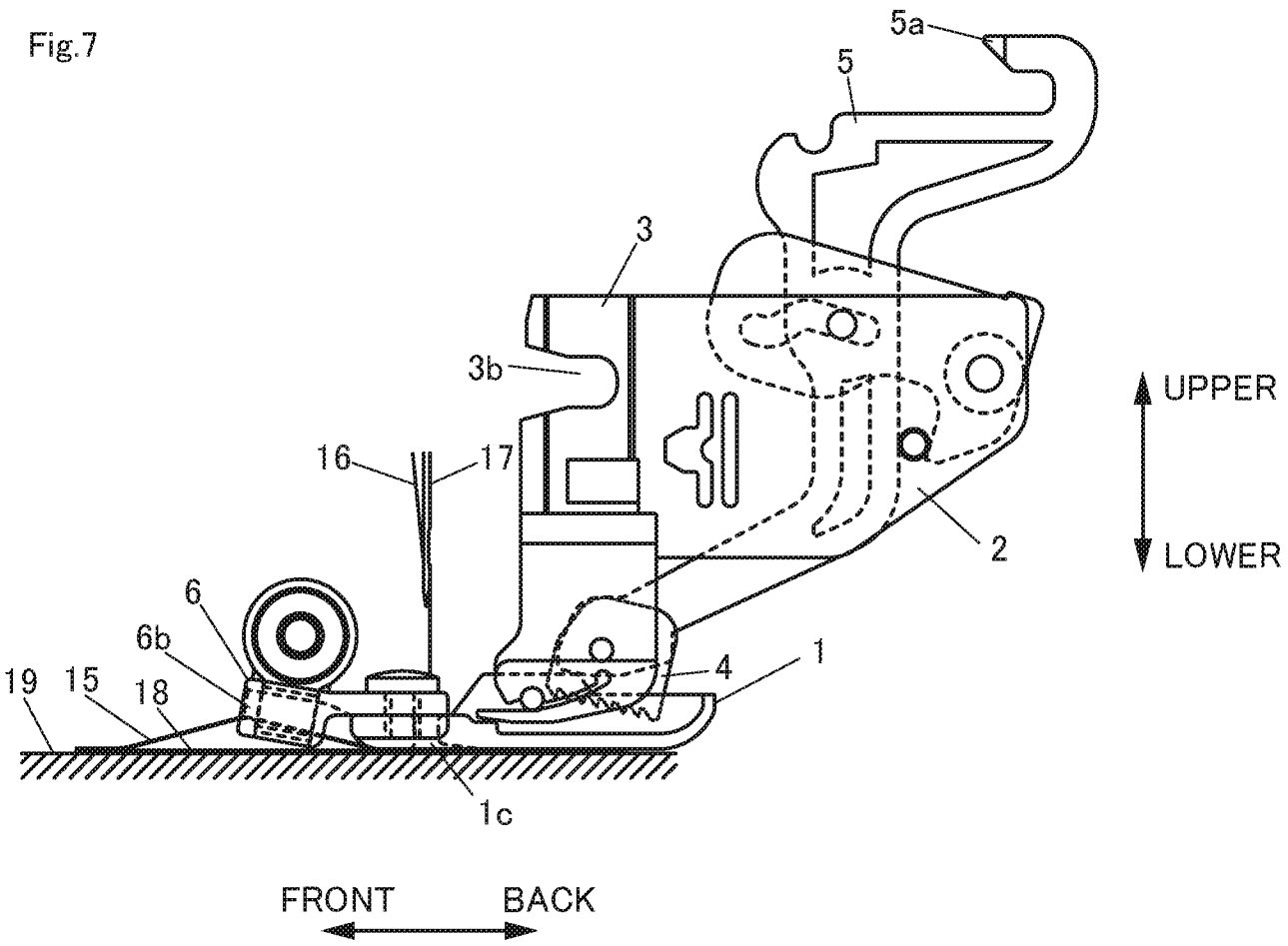
FIG. 7 is a right side view (as viewed from the arrow D in FIG. 6) showing the presser foot 100 together with the presser unit 2 in a state in which a ribbon is being sewn.

FIG. 7 is a right side view (as viewed from the arrow D in FIG. 6) showing the presser foot 100 together with the presser unit 2 in a state in which a ribbon is being sewn.

Figure 8:
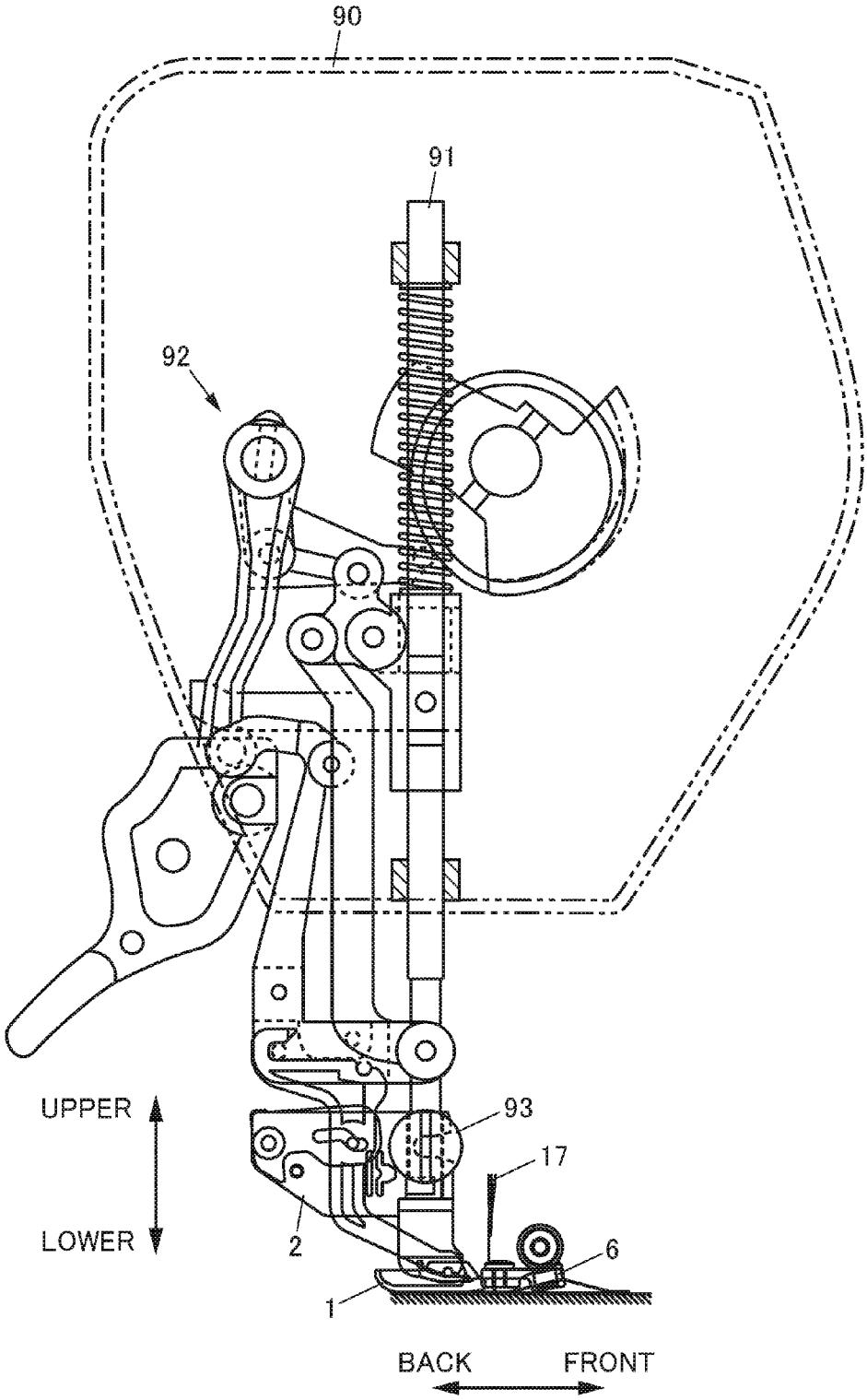
FIG. 8 is a diagram showing a sewing operation in a state in which the presser foot 100 and the presser unit 2 are mounted on a sewing machine 90.

FIG. 8 is a diagram showing a sewing operation in a state in which the presser foot 100 and the presser unit 2 are mounted on a sewing machine 90.

The presser unit 2 is fixed to a presser rod 91 by means of a screw 93 via a U-shaped groove 3*b* formed in the presser holder 3. This allows the presser unit 2 to be detachably coupled with the presser rod 91 and an upper feed driving mechanism 92 (see FIG. 8 showing these components) of the sewing machine 90 having an upper feed function. The presser unit 2 and the upper feed driving mechanism 92 form an upper feed mechanism. A hook 5*a* of an upper feed foot 5 provided to the presser unit 2 is engaged with the upper feed driving mechanism 92, thereby allowing the upper feed dog 4 to perform an upper feed operation.

It should be noted that the presser unit 2 and the upper feed driving mechanism 92 each have a known configuration (see Japanese Patent Application Laid Open No. 2013-52122, for example), and accordingly, detailed description thereof will be omitted. The configuration of the upper feed driving mechanism has been described for exemplary purposes only. That is to say, the configuration of the upper feed driving mechanism is not restricted to such a configuration described in Japanese Patent Application Laid Open No. 2013-52122.

A ribbon 15 having a width W, which is controlled by the guide portion 12*a* of the right guide 12 and the guide portion 14*a* of the left guide 14, is inserted into the window 6*b* of the guide base 6. Furthermore, sewing is executed for a cloth 18, which is a sewing target object, on a needle plate 19 by means of the sewing needle 17 through which a thread 16 is threaded. In this state, the position of the ribbon 15 is controlled by means of the guide portions 12*a* and 14*a*. Furthermore, the ribbon 15 is pressed in contact with the cloth 18 by means of the presser main body 1 with a suitable pressure, thereby providing high-precision sewing in a simple manner.

As described above, with the present embodiment, as a guide member, the right guide 12 and the left guide 14 are provided. Furthermore, as a linking portion, the adjustment screw 8, the right guide bush 11, and the left guide bush 13 are provided. Such components thus provided are configured as a guide mechanism for guiding a ribbon. Furthermore, the presser foot 100 having such a guide mechanism is configured to be connected in simple manner to the presser unit that operates according to the operation of the upper feed driving mechanism 92. Thus, with the presser foot 100 according to the present embodiment, only a rotational operation of the adjustment screw 8 is required to move the right guide 12 and the left guide 14 in conjunction with each other such that they are positioned symmetrically with the needle position as the base position. Thus, with the presser foot 100 according to the present embodiment, such an arrangement allows the guiding width to be adjusted in a simple manner according to the width of a ribbon (band-shaped member) to be used. In addition, such an arrangement requires no centering adjustment for a ribbon with respect to the needle position. Furthermore, the presser foot 100 according to the present embodiment provides an upper feed operation, thereby suppressing sewing misalignment between a sewing target object and a band-shaped member.

If such a female screw is directly formed in each of the right guide 12 and the left guide 14, in order to ensure that the center position of the width W matches the position of the sewing needle 17, such an arrangement requires high-precision manufacturing such that the male screw and the female screw have appropriate position phases. In contrast, with the presser foot 100 according to the present embodiment, the right guide 12 and the right guide bush 11 provided with the female screw are configured as separate members. Similarly, the left guide 14 and the left guide bush 13 provided with the female screw are configured as separate members. Thus, such an arrangement allows the guide portion 12*a* of the right guide 12 and the guide portion 14*a* of the left guide 14 to provide, in a simple manner, the position adjustment of the width W to be controlled.

Modification

The present invention is not restricted to such an embodiment described above. Rather, various modifications and changes may be made, which are encompassed within the scope of the present invention.

For example, description has been made with reference to an example in which the guide base 6 is fixed to the end of the presser main body 1 by means of the clamp screws 7 so as to form a single unit. However, the present invention is not restricted to such an arrangement. For example, a similar structure to the guide base 6 may be provided as a portion of the presser main body itself. That is to say, the presser main body 1 and the guide base 6 may be configured as a single component.

Description has been made with reference to an example using a so-called feed screw mechanism. However, the present invention is not restricted to such an arrangement. For example, a rack-and-pinion mechanism may be employed in the linking portion.

Description has been made in the present embodiment with reference to an example in which the presser foot 100 is configured to detachably be mounted to the presser unit 2, and the presser unit 2 is configured to be detachably mounted to the presser rod 91. However, the present invention is not restricted to such an arrangement. For example, an arrangement may be made in which the presser foot is detachably mounted to the presser unit, and the presser unit is fixedly connected to the presser rod. Also, the presser unit fixedly connected to the presser foot may be configured to be detachably mounted to the presser rod.

It should be noted that the embodiments and modifications may be mutually combined. However, detailed description thereof will be omitted. Also, the present invention is by no means restricted by the embodiments described above.

DESCRIPTION OF THE REFERENCE NUMERALS

1 presser main body, 1*a* rotational shaft, 1*b* operating space, 1*c* needle opening, 1*d* screw hole, 2 presser unit, 3 presser holder, 3*a* holder groove, 3*b* U-shaped groove, 4 upper feed dog 4, 5 upper feed foot, 6 guide base, 6*a* boss portion, 6*b* window, 6*c* groove, 6*d* groove, 6*e* hole, 6*f* hole, 6*g* center of guide base 6 (needle center), 7 clamp screw, 8 adjustment screw, 8*a* right male screw, 8*b* left male screw, 8*c* cut face, 9 operation ring, 10 screw, 11 right guide bush, 11*a* right female screw, 12 right guide, 12*a* guide portion,

12*b* through hole, 13 left guide bush, 13*a* left female screw, 14 left guide, 14*a* guide portion, 14*b* through hole, 15 ribbon, 16 thread, 17 sewing needle, 18 cloth, 19 needle plate, 90 sewing machine, 91 presser rod, 92 upper feed driving mechanism, 93 screw, 100 presser foot.

What is claimed is:

1. A presser foot for a sewing machine comprising:

a presser main body that has an opening in which an upper feed dog is arranged, and that presses a sewing target object;

a connection portion that is connected to an upper feed mechanism of the sewing machine;

a guide base attached to the presser main body so as to form a single unit, and configured to guide a band-shaped member to be sewn to the sewing target object;

guide members configured as a pair of members that move relative to the guide base, that guide a position of the band-shaped member in a width direction, and that are arranged symmetrically with a position at which a sewing needle moves in a vertical direction as a base position; and a linking portion that links movements of the guide members such that they are positioned symmetrically at all times with respect to the base position.

2. The presser foot for a sewing machine according to claim 1, wherein the linking portion comprises:

a male screw member configured such that a right male screw is formed in one end thereof, and such that a left male screw is formed in the other end thereof;

a right female screw provided to one of the guide members, and configured to be joined to the right male screw; and a left female screw provided to the other one of the guide members, and configured to be joined to the left male screw.

3. The presser foot for a sewing machine according to claim 2, wherein the right female screw and the left female screw are each configured as a component separate from the guide members as a separate female screw member, and wherein each female screw member is applied to the corresponding guide member so as to form a single unit, thereby providing the right female screw and the left female screw to the corresponding guide members.

4. The presser foot for a sewing machine according to claim 1, wherein the presser main body is connected to a presser unit mounted to a presser rod included in the sewing machine having an upper feed mechanism, and wherein the presser unit is configured to be detachably mounted to the presser rod.

5. The presser foot for a sewing machine according to claim 2, wherein the presser main body is connected to a presser unit mounted to a presser rod included in the sewing machine having an upper feed mechanism, and wherein the presser unit is configured to be detachably mounted to the presser rod.

6. The presser foot for a sewing machine according to claim 3, wherein the presser main body is connected to a presser unit mounted to a presser rod included in the sewing machine having an upper feed mechanism, and wherein the presser unit is configured to be detachably mounted to the presser rod.

* * * * *